US006575140B2

(12) United States Patent
Boecking

(10) Patent No.: US 6,575,140 B2
(45) Date of Patent: Jun. 10, 2003

(54) FUEL INJECTION APPARATUS FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/070,372

(22) PCT Filed: Jun. 13, 2001

(86) PCT No.: PCT/EP01/06693

§ 371 (c)(1),
(2), (4) Date: Jun. 12, 2002

(87) PCT Pub. No.: WO02/02931

PCT Pub. Date: Jan. 10, 2002

(65) Prior Publication Data

US 2002/0170536 A1 Nov. 21, 2002

(30) Foreign Application Priority Data

Jul. 6, 2000 (DE) ..... 100 32 924

(51) Int. Cl.[7] ..... F02M 37/04
(52) U.S. Cl. ..... 123/467; 123/506; 123/458
(58) Field of Search ..... 123/458, 500, 123/501, 467, 457, 506; 239/88–95, 86, 87

(56) References Cited

U.S. PATENT DOCUMENTS 4,217,862 A * 8/1980 Fort et al. ..... 123/487
5,526,791 A * 6/1996 Timmer et al. ..... 123/467
6,027,047 A * 2/2000 Augustin ..... 239/533.3
6,067,955 A * 5/2000 Boecking ..... 123/299
6,382,189 B1 * 5/2002 Hlousek ..... 123/506

FOREIGN PATENT DOCUMENTS

| | | | |
|---|---|---|---|
| DE | 19512730 | * | 8/1996 |
| DE | 19860678 | * | 7/2000 |
| DE | 19939448 | * | 3/2001 |
| DE | 19951004 | * | 4/2001 |
| EP | 0878623 | * | 11/1998 |
| EP | 0967383 | * | 12/1999 |

* cited by examiner

*Primary Examiner*—Carl S. Miller
(74) *Attorney, Agent, or Firm*—Ronald E. Greigg

(57) ABSTRACT

A fuel injection apparatus for internal combustion engines is proposed, which has a high-pressure fuel source from which fuel is supplied to an injection opening by means of a control valve unit. The control valve unit has a valve body, a valve member disposed in an axially mobile manner inside this valve body, and an actuator unit that actuates the valve member. A first high-pressure line connected to the high-pressure fuel source feeds into a first valve chamber of the control valve unit. In addition, a first valve seat is provided on an outer diameter of the valve body between the first valve chamber and a second valve chamber that communicates with the injection opening by means of a second high-pressure line. A second valve seat is formed on an inner diameter of the valve member and is engaged by a closing device.

13 Claims, 1 Drawing Sheet

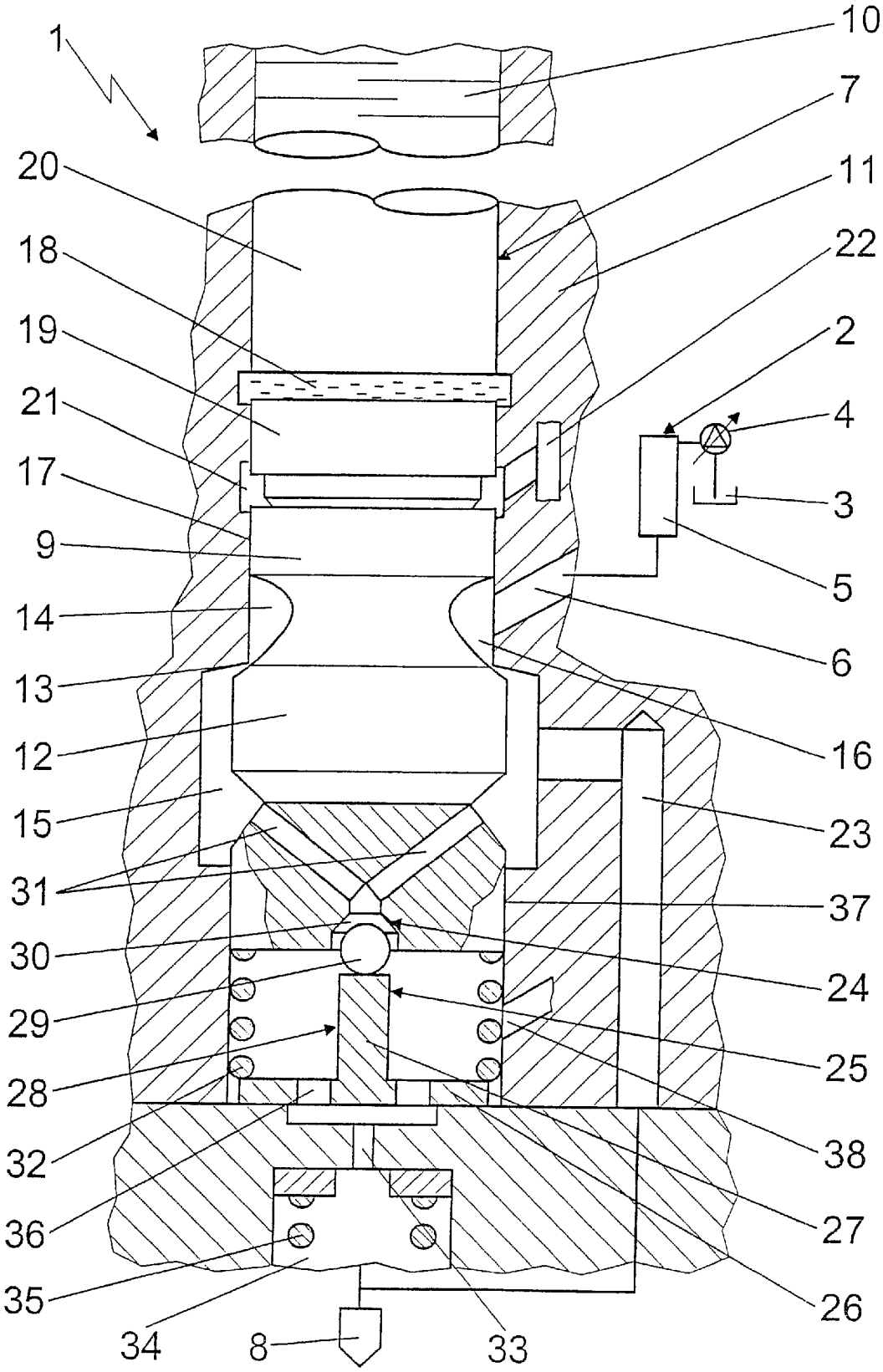
1
10
7
20
11
18
22
19
2
21
4
17
3
9
5
14
6
13
16
12
15
23
31
37
30
24
29
25
28
38
32
27
36
26
35
34
8
33

FUEL INJECTION APPARATUS FOR INTERNAL COMBUSTION ENGINES

CROSS-REFERENCE TO RELATED APPLICATIONS

This application is a 35 U.S.C. 371 application of PCT/EP 01/06693, filed on Jun. 13, 2001.

BACKGROUND OF THE INVENTION

1. Field of the Invention

The invention relates to a fuel injection apparatus for internal combustion engines in which a control valve unit for metered fuel injection is inserted into a fuel conduit from a high-pressure fuel source to an injection opening.

2. Description of the Prior Art

Fuel injection apparatuses of this type with which this invention is concerned, known from the prior art, are particularly used in common rail systems to control the supply of fuel to the injection opening, which is usually embodied as a nozzle holder device, generally by means of a slide valve or seat/slide valve, which can be embodied as force-compensated or partially force-compensated.

These known slide valves or seat/slide valves have control edges for covering and uncovering inlets and outlets, where the usually small overlaps result in large leakage fuel flows inside the slide valves, which has a disadvantageous effect on the injection of fuel into a combustion chamber of an internal combustion engine.

For this reason, there has been a transition to the use of double seat valves for the controlled injection of fuel, which have the advantage over slide valves that a stroke length is considerably increased and a high degree of sealing action at the valve seats can be achieved. Double seat valves also have the advantage over slide valves that the stroke length in a double seat valve can, on the other hand, be selected to be small so that the double seat valve can be directly controlled by a piezoelectric unit while complying with the requirement for a force-compensated or partially force-compensated valve.

DE 198 60 678 has disclosed a fuel injection apparatus for internal combustion engines in which a fuel injection valve is supplied with fuel by means of a high-pressure line. This known fuel injection apparatus has an injection valve member, which is for controlling an injection opening and whose axial movement in an injection valve body—and therefore the opening of the injection nozzle—is controlled by a control unit, which is embodied as a piezoelectric actuator and can be used to actuate the injection valve member.

The injection valve member is embodied with a valve head, which cooperates with two valve seats of the injection valve body of the control valve unit in such a way that when electrical voltage is applied to the piezoelectric actuator, this permits a flow of fuel, which is conveyed from the high-pressure fuel source by means of a high-pressure line, via the first valve seat and the second valve seat, through the fuel injection valve, and into an additional high-pressure line leading to the injection opening.

However, it has proven to be disadvantageous that it is particularly difficult to produce the complex design of the valve housing and the injection valve body, with numerous mold joints in the assembly of a force-compensated or partially force-compensated valve with a multi-part valve body.

SUMMARY OF THE INVENTION

The fuel injection apparatus for internal combustion engines according to the invention has the advantage that the control valve unit has outwardly opening first valve seat on the outer diameter of the valve body and an inwardly opening second valve seat, which valve seats do not have to face each other with regard to the orientation, as a result of which the control valve unit has a design that is very easy to manufacture from a production engineering standpoint. This arrangement affords significant latitude in manufacturing tolerances, which reduces production costs.

It is also advantageous that the control valve unit is provided in the form of a precisely functioning 3/2-way valve in a pressure-controlled system, which valve can be directly actuated preferably by a piezoelectric actuator unit, were the integration of the control valve unit into the inlet of fuel into the injection opening of the fuel injection apparatus permits short injections that can be precisely metered.

One significant advantage of the fuel injection apparatus according to the invention is represented by the design of the control valve unit with a closing device on the side of the valve member oriented away from the piezoelectric unit, since this closing device, due to its design with a closing body and a closing element disposed between the closing body and the valve member, is self-centering, as a result of which only minimal demands have to be placed on the manufacturing tolerances.

BRIEF DESCRIPTION OF THE DRAWINGS

An exemplary embodiment is shown in the drawing and explained in detail herein below, with reference to the drawings, in which the sole FIGURE schematically depicts a fuel injection apparatus for internal combustion engines according to the invention, with a fuel conduit leading from a high-pressure fuel reservoir, particularly showing the design of a control valve unit of the fuel injection apparatus.

DESCRIPTION OF THE PREFERRED EMBODIMENTS

The FIGURE shows a fuel injection apparatus 1 for internal combustion engines of motor vehicles, which is embodied as a common rail injector preferably for injecting diesel fuel. The common rail system includes a high-pressure fuel source 2, which is embodied with a high-pressure fuel reservoir 5. A high-pressure fuel-supply pump 4 supplies the high-pressure fuel reservoir 5 with fuel that has been compressed to injection pressure and comes from a fuel reservoir 3. A first high-pressure line 6 also leads from the high-pressure fuel reservoir 5 to a control valve unit 7, which conveys the fuel to an injection opening 8 for injection; this injection opening is only symbolically indicated in the FIGURE and can be conventionally embodied as a nozzle holder device.

In order to adjust an injection onset, an injection duration, and a fuel injection quantity by means of the fuel supply, the control valve unit 7 is embodied with a valve member 9, which is controlled or actuated by means of an actuator unit embodied as a piezoelectric actuator 10.

The valve member 9 is cylindrically embodied and is disposed in axially mobile fashion in a valve body 11; in an approximately central region, it has an annularly embodied collar or valve head 12, which on its side oriented toward the piezoelectric actuator 10, has a plate-like valve head sealing surface, which it uses—together with a first valve seat or outer valve seat 13, which is on the same side as piezoelectric actuator and opens outward in relation to the control valve unit 7—to separate a first valve chamber 14 and a second valve chamber 15 when it is not actuated by the piezoelectric actuator 10. The valve body 11 is embodied of one piece in the vicinity of the valve member, which achieves a simple design of the control valve unit 7 and requires less of a sealing expense.

As shown in the FIGURE, the high-pressure line 6 leading from the high-pressure fuel source 2 feeds into the first valve chamber 14, which is formed between the valve body 11 and an annular groove-like recess 16 of the valve member 9 when the valve member 9 rests with its valve head 12 against the outer valve seat 13.

The first valve chamber 14, in which high pressure permanently prevails by means of the high-pressure line 6 during operation of the fuel injection apparatus 1, is adjoined on the piezoelectric actuator side by a first guide 17 of the valve member 9 in the valve body 11, which guide has the same diameter as the outer valve seat 13.

Between the piezoelectric actuator end of the valve member 9 and a hydraulic chamber 18 serving as a hydraulic transmission, there is a first transmission piston 19, which transmits a length change of the piezoelectric actuator 10, which is caused by the application of a voltage to the piezoelectric actuator 10, to the valve member 9.

A second transmission piston 20 is provided between the piezoelectric actuator 10 and a hydraulic chamber 18, and is inserted with its end oriented away from the piezoelectric actuator 10 into the hydraulic chamber 18. The hydraulic chamber 18 serves on the one hand as an element for transmitting length change of the piezoelectric actuator 10 and on the other hand, serves as a compensation element for temperature-induced expansion fluctuations of the components around it.

In the contact region between the first transmission piston 19 and the valve member 9, an annular chamber 21 is provided in the valve body 11 around the valve member 9 and the first transmission piston 19, and a first leakage line 22 leads from this annular chamber 21.

The first leakage line 22 is provided to drain the valve body 11 of highly pressurized fuel, which travels into the first valve chamber 14 by means of the high-pressure line 6 and climbs toward the piezoelectric actuator 10 in the control valve unit 7 by means of the first guide 17. This prevents the hydraulic chamber 18 from being subjected to the high pressure of the supplied fuel, which would lead to an uncontrolled opening of the control valve unit 7.

The side of the first valve chamber 14 remote from the piezoelectric actuator 10 is adjoined by the second valve chamber 15 from which a second high-pressure line 23 branches, which communicates with the injection opening 8.

Also on the side of the valve member 9 remote from the piezoelectric actuator 10, a second valve seat or inner valve seat 24 is provided, which opens inward in relation to the control valve unit 7 and is constituted by the valve member 9, and which is engaged by a closing device 25. The closing device 25 constitutes a stroke limiter for the valve member 9; the closing device 25 has a closing body 28, which is comprised of a plate 26 and a pin 27, and has a closing element 29, which is disposed between the pin 27 and the valve member 9; the closing element 29 is in turn embodied as spherical and on its side oriented toward the pin 27, is flattened for the sake of an improved contact between the pin and the closing element 29.

The closing element 29 is disposed partially inside a bore 30 of the valve member 9, which is in turn connected to the second valve chamber 15 by means of conduits 31 provided in the valve member 9.

The diameter of the closing element 29 and an at least approximately conically embodied end region of the bore 30 are provided in such a way that the bore 30 is closed by the closing element 29 when the valve member 9 is actuated by the piezoelectric actuator 10 and fuel is prevented from passing through the bore 30 by means of the conduits 31.

A spring 32 is disposed between the plate 26 of the closing body 28 and the valve member 9; the plate 26 of the closing body 28 rests against the valve body 11 with its side oriented away from the piezoelectric actuator 10, and the pin 27 of the closing body 28 extends from the plate 26 toward the valve member 9.

An outer diameter of the plate 26 in the vicinity of the closing device 25 is smaller than an inner diameter of the valve body 11. This assures that when the valve member 9 is actuated by the piezoelectric actuator 10, through a self-adjustment of the closing body 28, which is made possible by means of a play between the plate 26 and the valve body 11 and the closing element 29 that is disposed so that it can slide in relation to the pin 27, the closing element 29 always comes into optimal contact with the inner valve seat 24 and achieves a high degree of sealing action.

In the vicinity of the contact surface of the plate 26, the valve body 11 has an outlet conduit 33, which is connected to a spring chamber 34 of a nozzle spring 35, whose spring force and initial tension can be used to adjust the opening force of the injection opening 8. The outlet conduit 33 is covered by the plate 26 and the and in order to convey fuel away from the vicinity of the closing device 25 into the leakage while chamber 34, outlet openings 36 that coincide with the outlet conduit 33 are provided in the plate 26.

As shown in the FIGURE, in the region between a second guide 37 and the outlet conduit 33, an additional leakage line 38 is provided to relieve the control valve unit 7 and to discharge excess fuel from this region of the control valve unit 7, which represents the discharge side of the control valve unit 7 for the leakage oil.

In the current embodiment, the second guide 37 is designed to have a play, which is greater than the play of the first guide by a factor of 2 to 3 so as not to overstress the system. Naturally in other embodiments, a different play can also be provided, which is, for example, greater than the play of the first guide 17 by a factor of 2 to 5, where the first guide 17 can have a play of preferably 1 to 4 micrometers and the second guide 37 can have a play of 4 to 10 micrometers.

The fuel injection apparatus 1 according to the FIGURE in the drawing functions in the manner described below.

When the injection opening 8 is closed, i.e. when the piezoelectric actuator 10 is not supplied with current, the valve member 9 rests with the valve head 12 against the outer valve seat 13 and is acted on with an initial spring tension by the spring 32. In this position of the valve member 9, no leakage oil flows via the inner valve seat 24, as a result of which the leakage oil quantity is kept to a minimum.

Above the outer valve seat 13, high pressure from the high-pressure fuel source 2 prevails in the first valve chamber 14. In order to open the injection opening 8, voltage is applied to the piezoelectric actuator 10, which produces a sudden axial expansion of the piezoelectric actuator 10. The rapid actuation of the piezoelectric actuator 10 produces an actuation pressure or opening pressure in the hydraulic chamber 18, which is transmitted to the valve member 9 by means of the first transmission piston 19, the hydraulic chamber 18, and the second transmission piston 20. As a result, the translation of the transmission of the length change of the piezoelectric actuator 10 is completely decoupled from the valve member 9.

Since the force compensation of the control valve unit 7 is only slightly limited, i.e. since it is almost completely force-compensated, it can be actuated directly. In order to actuate the valve member 9, the piezoelectric actuator need only overcome the spring force of the spring 32 and a force exerted by the high pressure of the fuel acting on the valve member 9.

If the opening pressure produced by the piezoelectric actuator 10 is transmitted to the valve member 9 by means of the hydraulic chamber 18, the first and second transmission pistons 19, 20, or an alternative mechanical transmission device, and this valve member 9 is lifted up from the outer valve seat 13, then the highly pressurized fuel supplied to the control valve unit 7 flows out of the high-pressure line 6, via the first valve chamber 14 and the open outer valve seat 13, into the second valve chamber 15. From there, the fuel travels into the second high-pressure line 23, which leads to the injection opening 8. In this open state of the control valve unit 7, the valve member 9 comes to rest with the conical end region of the bore 30 against the closing element 29, which produces a reliable seal in the open state of the control valve unit 7.

In order to close the injection opening 8, the supply of current to the piezoelectric actuator 10 is interrupted, which causes the actuator to retract to its original axial length, and reduces the actuation pressure in the hydraulic chamber 18. As a result, the valve member 9 is moved back toward the outer valve seat 13 by the spring 32, which interrupts the sealing action at the inner valve seat 24.

During the closing process, leakage oil is drained from the control valve unit 7 by means of the conduits 31, the bore 30, and the additional leakage line 38, as a result of which the control valve unit 7 is relieved in a simple fashion as it closes. Furthermore, when the inner valve seat 24 is closed by the closing device 25, the control valve unit 7 and the spring chamber 34 can be relieved by the outlet conduit 33, the outlet bores 36, and the additional leakage line 38.

According to the current exemplary embodiment, the control valve unit 7 is designed to be force-compensated in the upper region, i.e. above the valve head 12, whereas the lower region, i.e. the region of the valve member 9 remote from the piezoelectric actuator, is not force-compensated or is partially force-compensated.

An embodiment of the control valve unit that differs from the current exemplary embodiment can naturally also include the provision that the valve member, with its end oriented toward the piezoelectric actuator, is directly connected to or inserted into the hydraulic chamber without the interposition of a first transmission piston and therefore is subjected to the actuation pressure directly by means of the hydraulic chamber. The foregoing relates to preferred exemplary embodiments of the invention, it being understood that other variants and embodiments thereof are possible within the spirit and scope of the invention, the latter being defined by the appended claims.

I claim:

1. A fuel injection apparatus (1) for internal combustion engines with a high-pressure fuel source (2) from which fuel is supplied to an injection opening (8) by means of a control valve unit (7), the control valve unit (7) having a valve body (11), a valve member (9) disposed in an axially mobile manner inside the valve body, and an actuator unit (10) that actuates the valve member (9), a first high-pressure line (6) connected to the high-pressure fuel source (2) feeding into a first valve chamber (14) of the control valve unit (7), and a first valve seat (13) on an outer diameter of the valve body (11) between the first valve chamber (14) and a second valve chamber (15) communicating with the injection opening (8) by means of a second high-pressure line (23), and where a second valve seat (24) is formed on an inner diameter of an end portion of the valve member (9) which is guided in a guide (37) and is engaged by a closing element (29), of a closing device (25) which cooperates with an at least approximately conically embodied end region of a bore (30,31) of the valve member (9), connecting said second valve chamber (15) to an outlet conduit (33), the second valve chamber (15) is defined by the first valve seat (13), the valve member (9), and the valve body (11), and wherein the second valve chamber (15) adjoins the first valve chamber (14) on the side of the first valve seat (13) remote from the actuator unit (10).

2. The fuel injection apparatus according to claim 1 wherein the valve body (11) is embodied of one piece, at least in the vicinity of the valve member (9).

3. The fuel injection apparatus according to claim 1 wherein the closing device (25) is disposed on the side of the valve member (9) remote from the actuator unit (10) and is preferably embodied with an at least approximately spherical closing element.

4. The fuel injection apparatus according to claim 2 wherein the closing device (25) is disposed on the side of the valve member (9) remote from the actuator unit (10) and is preferably embodied with an at least approximately spherical closing element.

5. The fuel injection apparatus according to claim 3 wherein the closing device (25) has a closing body (28), which is comprised of a plate (26) and a pin (27), and wherein the closing element (29) is disposed between the pin (27) and the valve member (9) and is flattened on its side oriented toward the pin (27).

6. The fuel injection apparatus according to claim 4 wherein the closing device (25) has a closing body (28), which is comprised of a plate (26) and a pin (27), and wherein the closing element (29) is disposed between the pin (27) and the valve member (9) and is flattened on its side oriented toward the pin (27).

7. The fuel injection apparatus according to claim 5 further comprising a spring (32) provided between the plate (26) of the closing body (28) and the valve member (9), wherein the plate (26) rests against the valve body (11) with its side remote from the actuator unit (10) and the pin (27) of the closing body (28) extends from the plate (26) toward the valve member (9), and wherein an outer diameter of the plate (26) in the vicinity of the closing device (25) is designed to be smaller than the inner diameter of the valve body (11).

8. The fuel injection apparatus according to claim 7 wherein in the vicinity of the contact surface of the plate (26), the valve body (11) has the outlet conduit (33), which is covered by the plate (26), and at least one outlet bore (36), which coincides with the outlet conduit (33), is provided in the plate (26).

9. The fuel injection apparatus according to claim 1 wherein the first valve chamber (14) is defined by an additional guide (17) of the valve member (9) in the valve body (11), the additional guide is disposed between the valve body (11), the valve member (9), and by the first valve seat (13), where the additional guide (17) is provided between the actuator unit (10) and the first valve chamber (14).

10. The fuel injection apparatus according to claim 9 wherein on the side of the additional guide (17) oriented toward the actuator unit (10), an annular chamber (21) is provided, from which a first leakage line (22) branches.

11. The fuel injection apparatus according to claim 1 wherein the actuator unit is embodied as it piezoelectric unit (10), which actuates the valve member (9) by means of a hydraulic chamber (18), the hydraulic chamber (18) is preceded by a first transmission piston (19), the end of the valve member (9) oriented toward the piezoelectric unit (10) being operationally connected to the hydraulic chamber (18) by means of a second transmission piston (20).

12. The fuel injection apparatus according to claim 9 wherein the actuator unit is embodied as it piezoelectric unit (10), which actuates the valve member (9) by means of a hydraulic chamber (18), the hydraulic chamber (18) is preceded by a first transmission piston (19), the end of the valve member (9) oriented toward the piezoelectric unit (10) being operationally connected to the hydraulic chamber (18) by means of a second transmission piston (20).

13. The fuel injection apparatus according to claim 1 wherein the high-pressure fuel source (2) is embodied as a common rail system and the fuel injection apparatus (1) represents a pressure-controlled common rail system.

* * * * *